US006095847A

United States Patent [19]

Lin

[11] Patent Number: 6,095,847

[45] Date of Patent: Aug. 1, 2000

[54] WATERTIGHT LAMP SOCKET FOR LAMP BELT

[76] Inventor: Yuan Lin, 18F-2, No.2, Lane 175, Sec.3, Shiou-Lang Road, Chung-Ho City Taipei Hsien 235, Taiwan

[21] Appl. No.: 09/323,004

[22] Filed: Jun. 1, 1999

[51] Int. Cl.[7] ..... H01R 4/24

[52] U.S. Cl. ..... 439/414; 439/280

[58] Field of Search ..... 439/414, 188, 439/280, 419, 277

[56] References Cited

U.S. PATENT DOCUMENTS

| | | | |
|---|---|---|---|
| 1,849,846 | 3/1932 | R. S. McNeil | 439/414 |
| 5,660,560 | 9/1997 | Cheng et al. | 439/419 |
| 5,667,296 | 9/1997 | Cheng et al. | 362/267 |
| 5,967,823 | 10/1999 | Tsui | 439/280 |

*Primary Examiner*—Khiem Nguyen
*Assistant Examiner*—Son V. Nguyen

[57] ABSTRACT

A watertight lamp socket for lamp belt mainly including a seat having an internally threaded upper portion and a downward opened lower recess portion, a conductor extending across the lower recess portion of the seat, and a bottom cover screwed to a bottom of the lower recess portion to clamp the conductor between the seat and the bottom cover. A sealing member is put around a joint of the lamp socket and a lamp screwed into the internally threaded upper portion of the seat, so that a contact surface between the lamp and the sealing member is watertight. Two contact holes are provided on a top of the lower recess portion of the seat for two screws to downward extend therethrough and pierce into the conductor, so that current is supplied from the conductor via the screws to two conducting spring plates connected to the screws and to the lamp. The contact holes have downward flanges tightly pressing against the conductor to prevent any rainwater or moisture from permeating into the contact holes via the flanges to wet the screws and the conducting spring plates.

4 Claims, 4 Drawing Sheets

WATERTIGHT LAMP SOCKET FOR LAMP BELT

BACKGROUND OF THE INVENTION (a) Field of the Invention

The present invention relates to a lamp socket for a lamp belt, and more particularly to a watertight lamp socket for a lamp belt. A sealing member is provided around an outer periphery of a lamp socket to tightly enclose a joint of the socket and a base of a lamp mounted in the socket, such that rainwater is prevented from permeating through the sealing member into the socket. Vertically downward flanges are also provided around contact holes formed on a lower portion of the socket to tightly contact with a PVC sheath of a conductor of the lamp belt extended across the lower portion of the socket, so that rainwater is prevented from entering the contact holes via the flanges to cause any short circuit or damage to the lamp socket and the lamp mounted thereinto.

The lamp belt is a convenient and important means adopted by many fields, particularly commercial and entertainment fields, for decorating and/or advertising purpose. The lamp belt is also widely used in festivals to create the colorful and cheerful scenes. The lamp belt usually includes a plurality of lamp sockets continuously and serially arranged thereon to receive a plurality of lamps that give out sparkling and colorful lights that are eye catching and form very good means of advertising.

(b) Description of the Prior Art

A conventional lamp belt, however, has following drawbacks:

1. The lamp sockets thereon are not structurally watertight and moisture-proof. Rainwater tends to permeate through joints of the lamp sockets and the bases of lamps mounted in the lamp sockets, causing poor contact of conducting copper plates in the lamp sockets with the lamp bases and even causing dangerous sparks after the lamp belt has been used for a long time.
2. The lamp sockets thereon tend to have shortened usable lift due to environmental factors, such as acid rain that would cause undesirable damages to elements inside the lamp sockets due to oxidization.
3. The lamp sockets thereon are usually made of inferior materials that are not sufficiently heat-resistant. The lamp belt tends to give out dull lights and/or have easily burned-out or even cracked lamps to dangerously cause fires after being used for a period of time.
4. The lamp sockets thereon include complicate accessories and are difficult to assemble and disassemble. The lamp belt is therefore not economical and practical for use.

SUMMARY OF THE INVENTION

It is therefore a primary object of the present invention to provide a watertight lamp socket structure for the lamp belt, so that the lamp belt does not easily short-circuit due to rainwater permeated into the lamp sockets on the lamp belt.

Another object of the present invention is to provide a watertight and heat-resistant lamp socket structure for the lamp belt, so that the lamp belt may have increased usable life.

A further object of the present invention is to provide an economical and practical watertight lamp socket structure for the lamp belt that includes simplified elements and accessories and may be easily assembled and disassembled even by a general user.

To achieve the above and other objects, the lamp socket for the lamp belt according to the present invention mainly includes a sealing member provided around an outer periphery of the lamp socket to tightly enclose the joint of the lamp socket and the base of the lamp mounted in the lamp socket, such that rainwater is prevented from permeating into the lamp socket via the sealing member. Moreover, the lamp socket of the present invention has a lower downward opened recess portion. Lugs with central mounting holes extend from the lower recess portion for mounting the lamp socket onto a fixed position. Contact holes provided on a top of the downward opened recess have vertically downward flanges around them to tightly abut against a PVC sheath of a conductor of the lamp belt, so that rainwater is prevented from entering the seat via the contact holes to wet conducting plates inside the lamp socket and cause any short circuit or damage to the whole lamp belt.

The above objects and the means adopted by the present invention to achieve these objects may be easily understood by referring to the following detailed description of the preferred embodiment and the accompanying drawings thereof, wherein

DETAILED DESCRIPTION OF THE PREFERRED EMBODIMENTS

Figure 1:
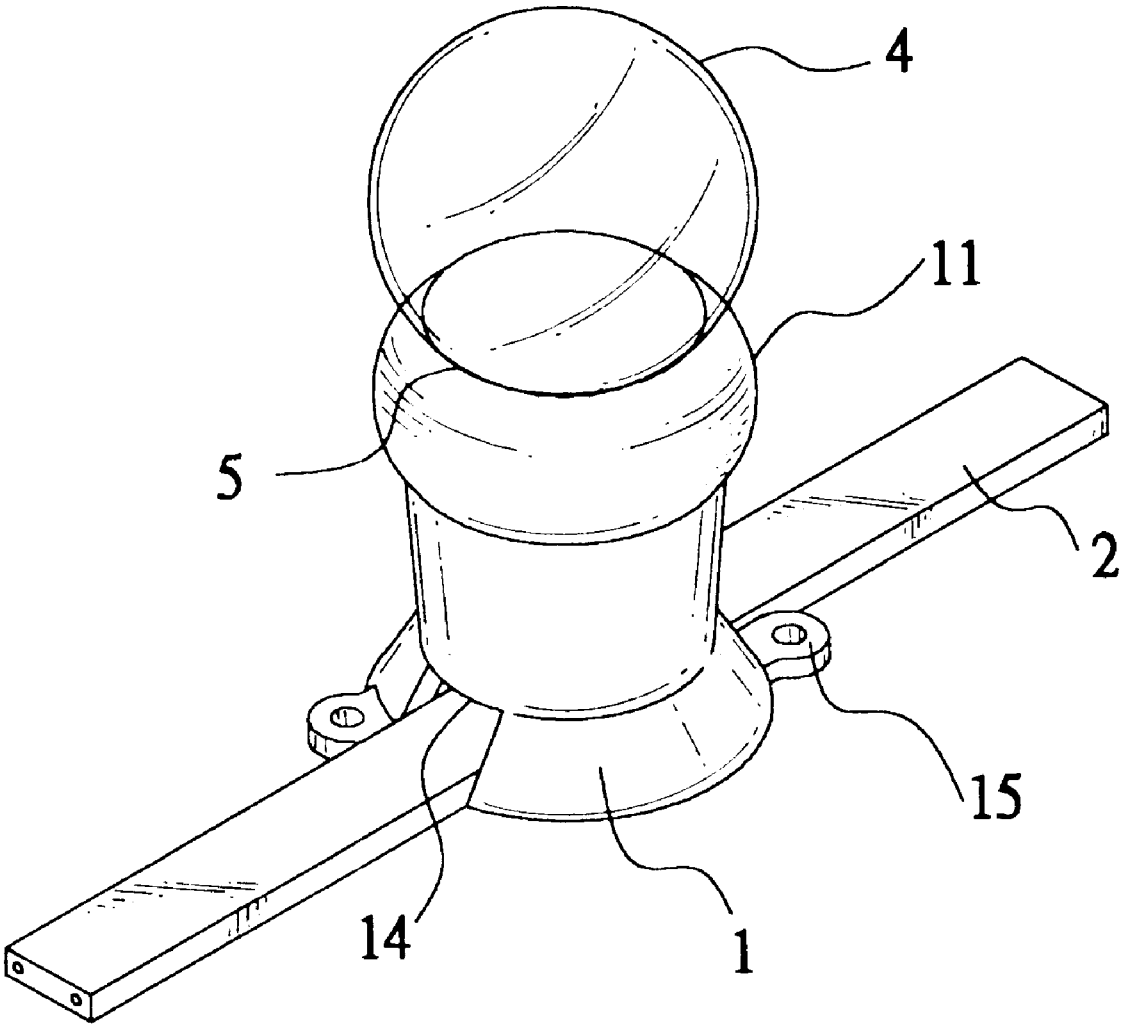
FIG. 1 is a fragmentary perspective of a lamp socket for a lamp belt according to the present invention.
Figure 2:
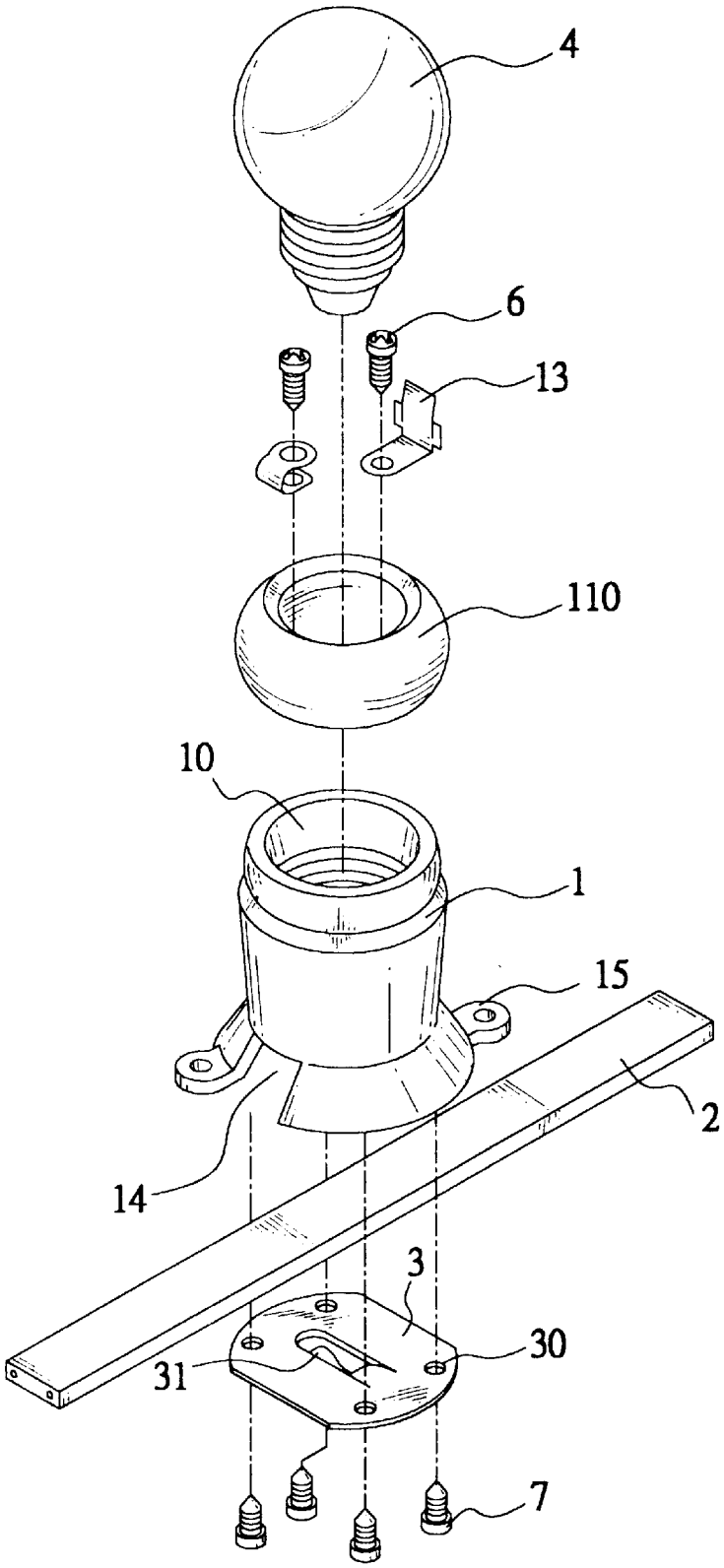
FIG. 2 is an exploded perspective of the lamp socket of FIG. 1.

Please refer to FIGS. 1 through 5. The lamp socket for a lamp belt according to the present invention mainly includes a seat 1, a conductor 2, and a bottom cover 3. A lamp 4 is removably fixed to the lamp socket by screwing a lamp base (not shown) of the lamp 4 into the seat 1 to engage with an internal thread 10 provided along an inner peripheral surface of the seat 1.

A sealing member 11, that may be either a watertight packing 110 or a watertight jacket, is tightly put around an upper outer periphery of the seat 1 to seal a joint of the lamp 4 and the seat 1, so that a contact surface 5 between the lamp 4 and the sealing member 11 is completely watertight without any clearance and is therefore protected against any rainwater that would otherwise permeate into the seat 1 via the joint of the lamp 4 and the seat 1.

Figure 3:
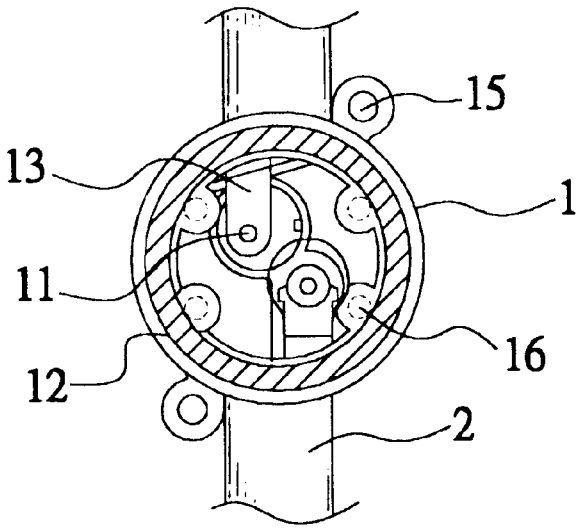
FIG. 3 is a top sectional view of the lamp socket of FIG. 1.
Figure 4:
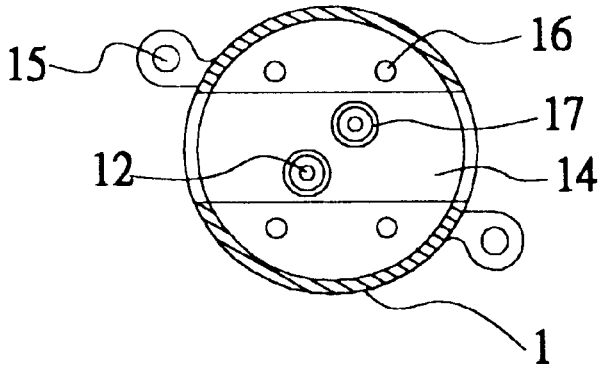
FIG. 4 is a bottom sectional view of the lamp socket of FIG. 1.
Figure 5:
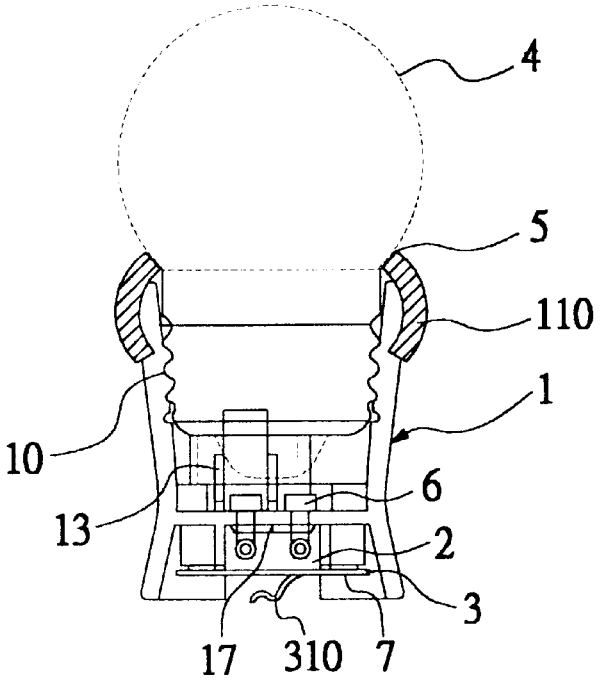
FIG. 5 is a side sectional view of the lamp socket of FIG. 1.

The seat 1 of the lamp socket of the present invention has a bottom portion in the form of a downward opened recess 14, as shown in FIG. 5. Two lugs 15 with fixing holes are provided at two opposite outer sides of the recess 14, so that fastening means (not shown) may be extended through the holed lugs 15 to fix the seat 1 to a predetermined position. A plurality of screw holes 16 are provided on a top of the downward opened recess 14 at predetermined points, as shown in FIG. 4. Two through contact holes 12 are also formed on the top of the recess 14 at suitable positions, as shown in FIGS. 3 and 4. Two conducting spring plates 13 are fixed in the seat 1 above the recess 14 and corresponding to the two contact holes 12 by threading screws 6 through the spring plates 13 and the contact holes 12. The screws 6 passing through the contact holes 12 pierce into the conductor 2, so that current is supplied from the conductor 2 to the lamp 4 via the screws 6 and the conducting spring plates 13. The contact holes 12 have vertically downward extended flanges 17 provided around them, as can be seen from FIGS. 4 and 5. The flanges 17 have lower edges tightly abutting against a PVC sheath of the conductor 2 to ensure watertight contact of the flanges 17 with the conductor 2, so that no rainwater is allowed to permeate into the contact holes 12 via the flanges 17 to wet the screws 6 and cause short-circuit between the screws 6 and the conductor 2.

The bottom cover 3 is mounted to a bottom of the seat 1 below the conductor 2. A plurality of screw holes 30 are formed on the bottom cover 3 corresponding to the screw holes 16 provided on the top of the downward opened recess 14 of the seat 1, so that the bottom cover 3 may be closed to the bottom of the seat 1 and firmly clamp the conductor 2 between the bottom cover 3 and the recess 14 by upward threading screws 7 through the screw holes 30 and the screw holes 16. A downward extended hanging means 31, that may be a hook 310, is formed on the bottom cover 3 at a proper position to facilitate hanging of the whole lamp socket of the present invention to an insulated wire (not shown).

Figure 6:
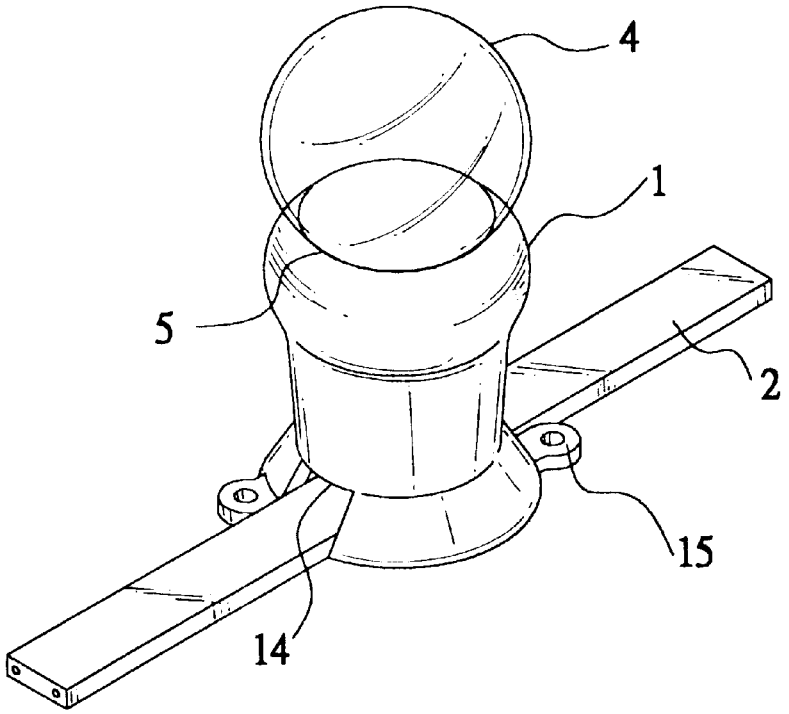
FIG. 6 is a preferred embodiment of the lamp socket of the present invention.

FIG. 6 illustrates a lamp socket for a lamp belt according to a preferred embodiment of the present invention.

With the above arrangements, the lamp socket of the present invention has simplified structure that includes simple elements and accessories for ease assembling and disassembling even by a general user. The sealing member 11 ensures a non-clearance contact surface 5 between the lamp 4 and the sealing member 11 and accordingly a watertight connection of the lamp 4 to the seat 1 of the lamp socket of the present invention. It is impossible for rainwater to permeate into the lamp socket via the sealing member 11 to wet the conducting spring plates 13 below the base of the lamp 4 and cause poor contact or even short-circuit of the lamp 4. The vertically downward flanges 17 around the contact holes 12 formed on the top of the downward opened recess 14 in the lamp socket is so designed that they tightly press against the PVC sheath of the conductor 2 when the conductor 2 is clamped between the recess 14 and the bottom cover 3, such that any rainwater is prevented from coming into the contact holes 12 and wetting the screws 6 that pierce into the conductor 2 to electrically connect the conducting spring plates 13 to the conductor 2. Whereby no lamp 4 mounted on the lamp socket of the present invention would burn out due to short-circuit caused by rainwater coming into the contact holes 12 via the flanges 17.

The seat 1 of the lamp socket is made of heat-resistant and acid-resistant material. The heat-resistant and acid-resistant material together with the sealing member 11 and the flanges 17 protect the lamp socket of the present invention from wetted and oxidized elements by acid rain and therefore enable the lamp socket to have increased usable life. The lamp socket for a lamp belt according to the present invention is therefore superior to the conventional ones in its watertight and heat-resistant ability, as well as its increased usable life and enhanced safety in use.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A lamp socket for lamp belt, comprising a seat, a conductor, and a bottom cover;

said seat being provided on an upper inner peripheral surface with an internal thread, such that a lamp is screwed into said lamp socket by engaging an externally threaded lamp base of said lamp with said internal thread of said seat; a sealing member being put around a joint of said lamp and said seat to tightly enclose a lower outer surface of said lamp, such that there is not any clearance at a contact surface between said lamp and said sealing member for any rainwater to permeate into said seat via said contact surface; said seat having a lower portion defining a downward opened recess, two contact holes being formed on a top of said downward opened recess for two first screws to downward extend therethrough to fix two conducting spring plates above said recess to said contact holes, said first screws downward piercing into said conductor that is located below said contact holes and extended across said recess, such that current is supplied from said conductor to said conducting spring plates and accordingly said lamp via said first screws; said two contact holes having vertically downward extended flanges around them, said flanges being downward tightly pressed against a PVC sheath of said conductor, such that rainwater is not permitted to permeate into said contact holes via said flanges to wet said first screws; and said bottom cover being mounted to a bottom of said downward opened recess below said conductor by upward threading second screws through holes formed on said bottom cover and holes correspondingly formed on said top of said recess, such that said conductor is clamped between said bottom cover and said top of said recess with said flanges around said contact holes tightly pressing against said conductor; and said bottom cover being formed at a suitable position with a downward extended hanging means for conveniently hanging said lamp socket to an insulated wire.

2. A lamp socket for lamp belt as claimed in claim 1, wherein said sealing member is a watertight packing.

3. A lamp socket for lamp belt as claimed in claim 1, wherein said sealing member is a watertight jacket.

4. A lamp socket for lamp belt as claimed in claim 1, wherein said hanging means on said bottom cover is a hook.

* * * * *